US009250007B2

(12) United States Patent
Kuehl et al.

(10) Patent No.: US 9,250,007 B2
(45) Date of Patent: Feb. 2, 2016

(54) HYDROPHILIC STRUCTURES FOR CONDENSATION MANAGEMENT IN APPLIANCES

(71) Applicant: Whirlpool Corporation, Benton Harbor, MI (US)

(72) Inventors: Steven John Kuehl, Stevensville, MI (US); John J. Vonderhaar, St. Joseph, MI (US); Guolian Wu, St. Joseph, MI (US); Mianxue Wu, St. Joseh, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/493,399

(22) Filed: Sep. 23, 2014

(65) Prior Publication Data

US 2015/0008815 A1 Jan. 8, 2015

Related U.S. Application Data

(63) Continuation of application No. 13/562,628, filed on Jul. 31, 2012, now Pat. No. 8,864,251.

(51) Int. Cl.
*F25D 21/14* (2006.01)
*F25D 23/06* (2006.01)

(52) U.S. Cl.
CPC ..... *F25D 21/14* (2013.01); *F25D 23/065* (2013.01); *F25D 2321/147* (2013.01); *F25D 2323/021* (2013.01)

(58) Field of Classification Search
CPC ... F25D 23/082; F25D 23/085; F25D 23/087; E06B 7/26; B60J 10/0045
USPC ..... 312/402, 405, 407
See application file for complete search history.

(56) References Cited

U.S. PATENT DOCUMENTS

| | | | |
|---|---|---|---|
| 1,751,899 | A | 3/1930 | Whitfield |
| 4,711,098 | A | 12/1987 | Kuwabara et al. |
| 5,720,183 | A | 2/1998 | Chang |
| 7,008,032 | B2 | 3/2006 | Chekal et al. |
| 7,204,568 | B2 | 4/2007 | Lim et al. |
| 7,659,491 | B2 | 2/2010 | Yang |
| 7,891,154 | B2 | 2/2011 | Cording |
| 7,951,426 | B2 | 5/2011 | Sharma |
| 8,083,305 | B2 | 12/2011 | Lee et al. |

(Continued)

FOREIGN PATENT DOCUMENTS

| | | | |
|---|---|---|---|
| WO | 2008026084 | A2 | 3/2008 |
| WO | 2010032445 | A1 | 3/2010 |

OTHER PUBLICATIONS

Response to Mar. 4, 2014 Non-Final Office Action dated Jun. 2, 2014, for U.S. Appl. No. 13/562,577, filed Jul. 31, 2012, entitled "[NETL] Hydrophilic Structure for Condensation Management on the Moveable Mullion of a Refrigerator."

(Continued)

*Primary Examiner* — Hanh V Tran

(57) ABSTRACT

An appliance that includes a cabinet having an exterior surface; a refrigeration compartment located within the cabinet; and a hydrophilic structure disposed on the exterior surface. The hydrophilic structure is configured to spread condensation. The appliance further includes a wicking structure located in proximity to the hydrophilic structure, and the wicking structure is configured to receive the condensation.

20 Claims, 7 Drawing Sheets

(56) References Cited

U.S. PATENT DOCUMENTS

| | | | |
|---|---|---|---|
| 8,434,317 | B2 | 5/2013 | Besore |
| 2002/0034627 | A1 | 3/2002 | Jacquiod et al. |
| 2002/0117949 | A1 | 8/2002 | Banicevic et al. |
| 2004/0104654 | A1 | 6/2004 | Lee et al. |
| 2005/0064173 | A1 | 3/2005 | Messere et al. |
| 2005/0129742 | A1 | 6/2005 | Bringley et al. |
| 2006/0152126 | A1 | 7/2006 | Collins et al. |
| 2007/0138925 | A1 | 6/2007 | Fu |
| 2008/0187728 | A1 | 8/2008 | Borowiec et al. |
| 2008/0209812 | A1 | 9/2008 | Lancry et al. |
| 2008/0276540 | A1 | 11/2008 | Kim |
| 2008/0296252 | A1 | 12/2008 | D'Urso et al. |
| 2009/0156394 | A1 | 6/2009 | Horiuchi et al. |
| 2009/0214606 | A1 | 8/2009 | Bujard et al. |
| 2009/0239051 | A1 | 9/2009 | Fukuda et al. |
| 2009/0273264 | A1 | 11/2009 | Butler |
| 2010/0101161 | A1 | 4/2010 | Dudash |
| 2010/0119705 | A1 | 5/2010 | Roche et al. |
| 2011/0050065 | A1 | 3/2011 | Lee et al. |
| 2011/0210656 | A1 | 9/2011 | Lemmer et al. |
| 2011/0212279 | A1 | 9/2011 | Lemmer et al. |
| 2011/0212298 | A1 | 9/2011 | Nakano et al. |
| 2012/0047919 | A1 | 3/2012 | Besore |
| 2012/0102985 | A1 | 5/2012 | Tafoya et al. |
| 2012/0283350 | A1 | 11/2012 | Saito et al. |

OTHER PUBLICATIONS

Werner et al., How to Check the Presense of Dew on Windows, Submitted to EuroSun 2010, Jun. 28, 2010, available at www.cerbof.se/documents/.../CERBOF__projekt__39__Slutrapport.pdf and www.eurosun2010.org/cms/poster.html, 8 pages.

HYDROPHILIC STRUCTURES FOR CONDENSATION MANAGEMENT IN APPLIANCES

CROSS-REFERENCE TO RELATED APPLICATION

This application is a continuation that claims the benefit under 35 U.S.C. §120 of prior U.S. patent application Ser. No. 13/562,628, filed on Jul. 31, 2012, entitled "HYDROPHILIC STRUCTURES FOR CONDENSATION MANAGEMENT IN REFRIGERATOR APPLIANCES," the entire disclosure of which is hereby incorporated by reference.

STATEMENT REGARDING FEDERALLY SPONSORED RESEARCH AND DEVELOPMENT

This invention was made with government support under Award No. DE-EE0003910, awarded by the U.S. Department of Energy. The government has certain rights in the invention.

FIELD OF THE INVENTION

The present invention relates to refrigeration appliances and, more particularly, to configurations that control and mitigate the effects of external condensation on the mullions and exterior surfaces of the fresh food and freezer compartments.

BACKGROUND OF THE INVENTION

Condensation on the exterior surfaces of refrigerator appliances is not aesthetically pleasing to consumers. It also may cause water to pool around the refrigerator, leading to safety problems. In addition, water condensation may enter the compartments of the appliance potentially causing a mess, a reduction in food quality, and components of the appliance to rust. Accordingly, there exists a need to manage condensation on the exterior surfaces of various refrigerator appliance configurations.

BRIEF SUMMARY OF THE INVENTION

One aspect of the present invention is to provide an appliance that includes a cabinet having an exterior surface; a refrigeration compartment located within the cabinet; and a hydrophilic structure disposed on the exterior surface. The hydrophilic structure is configured to spread condensation. The appliance further includes a wicking structure located in proximity to the hydrophilic structure, and the wicking structure is configured to receive the condensation.

A further aspect of the present invention is to provide an appliance that includes a cabinet having an exterior surface; a refrigeration compartment located within the cabinet; and a hydrophilic structure disposed on the exterior surface. The hydrophilic structure is configured to spread condensation. The appliance further includes a wicking finger in contact with the hydrophilic structure, and wicking finger transfers the condensation from the hydrophilic structure to a wicking structure located on the cabinet that is configured to receive the condensation from the wicking finger.

Another aspect of the present invention is to provide an appliance that includes a cabinet having an exterior surface; a refrigeration compartment located within the cabinet; and a hydrophilic structure disposed on the exterior surface. The hydrophilic structure is configured to spread condensation. The appliance further includes a wicking structure comprising a sponge-like material, and the wicking structure is configured to receive the condensation from the hydrophilic structure.

DETAILED DESCRIPTION

Figure 1:
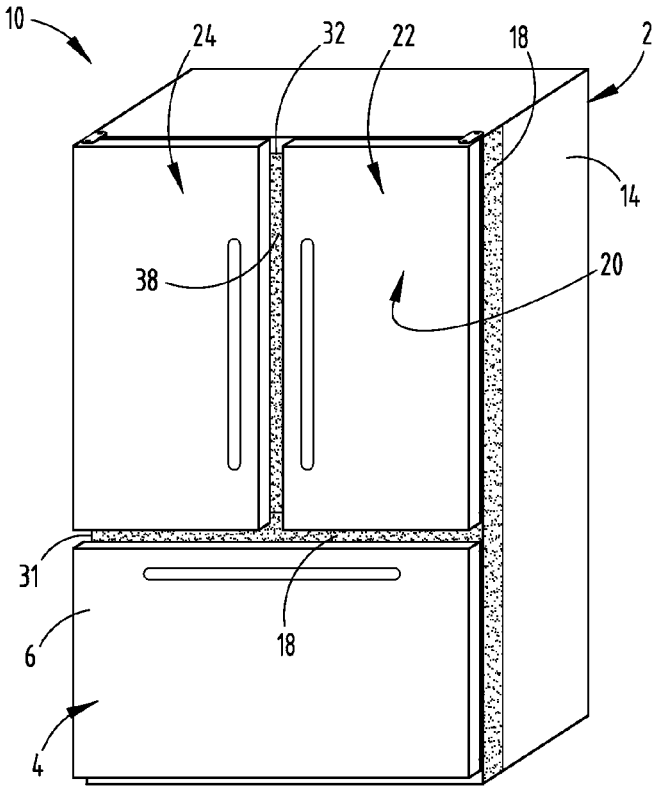
FIG. 1 is a perspective view of a refrigerator appliance in a French door bottom mount configuration, depicting portions of the cabinet arranged with a hydrophilic structure.

For purposes of description herein, the invention may assume various alternative orientations, except where expressly specified to the contrary. The specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Managing external water condensation is an issue for many refrigerator appliance configurations. Condensation may be observed on the flip mullion of French door bottom mount refrigerators (FDBM). Similarly, condensation can also be present on the exterior surfaces of the fresh food and freezer cabinets, and the mullion that divides them. Control of exterior condensation on a refrigerator appliance without additional energy usage is also desirable.

In particular, FDBM refrigerators describe a category of refrigerator appliances with a refrigeration compartment (i.e., fresh food compartment) that includes a pair of doors that open and close in a French-style. FDBM refrigerators usually have a flip mullion in the middle of the fresh food compartment. Typically, the mullion is attached to one of the fresh food compartment doors and configured to flip behind one of the doors when both doors are moved into a closed position. The mullion provides a resting place for the compartment doors when the doors are closed. It also seals the fresh food compartment in concert with the doors.

Usually the flip mullion is not well-insulated relative to other components in the fresh food compartment. Consequently, the mullion may experience external condensation, particularly in refrigerators that are used in high-humidity locations. Refrigerator appliance manufacturers often try to remedy this condensation problem by adding heater coils or other types of resistive-heating elements to the inside of the mullion. The heater brings the surface temperature of the mullion to a temperature above the dew point of the ambient air, ensuring that condensation does not form on the mullion. The heater, however, uses energy above and beyond the energy required for the cooling function of the appliance. This adds significant energy usage costs to the operation of the appliance over its life.

Similarly, condensation may form on certain portions of the exterior surfaces of the fresh food and freezer compartments of various refrigerator appliance configurations. Condensation may also form on the mullion that divides the compartments. Many fresh food and freezer cabinets have a well-insulated inner liner and a seam that separates the liner from the exterior cabinet surface. The seam is near the seal between the compartment and the door and usually is not well insulated. This location on the cabinet is frequently subject to exterior condensation. Accordingly, appliance manufacturers include heater coils in the portion of the fresh food and/or freezer compartment cabinets near these seams, including portions of the cabinet comprising the mullion between the compartments. These heaters prevent the formation of exterior condensation and, like the heaters used in the flip mullion in FDBM-type refrigerators, require significant energy usage.

Figure 1A:
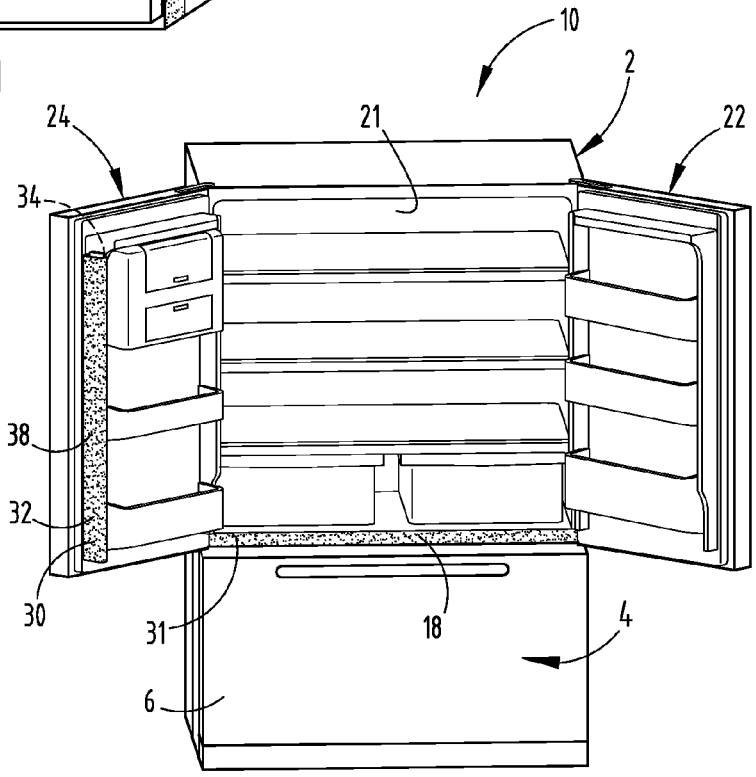
FIG. 1A is a perspective view of the refrigerator appliance shown in FIG. 1 with the doors to the fresh food compartment in an open position, exposing the mullion assembly arranged with a hydrophilic structure.

FIGS. 1 and 1A depict a French door bottom mount (FDBM) refrigerator appliance 10 having a movable, flip mullion assembly 30 with a mullion bar hydrophilic structure 38 configured for condensation management. Appliance 10 includes a cabinet 2 with a right-side section 14. Appliance 10 also includes a freezer compartment 4 and a refrigeration compartment 20 (i.e., fresh food compartment). A divider mullion 31 divides the freezer compartment 4 and refrigeration compartment 20. The freezer compartment 4 includes a door 6. The refrigeration compartment 20 includes a first refrigeration compartment door 22 and a second refrigeration compartment door 24. The compartment doors 22 and 24 are depicted in a closed configuration.

Figure 1B:
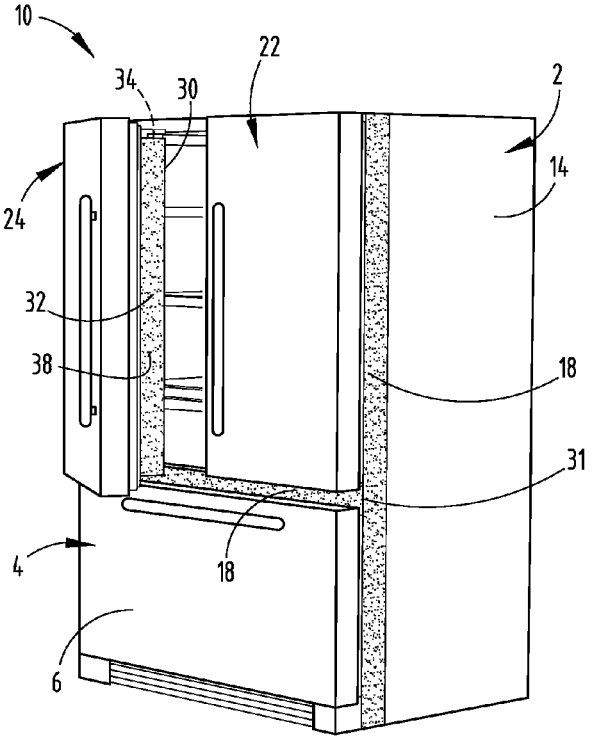
FIG. 1B is another perspective view of the refrigerator appliance shown in FIG. 1 with one of the doors to the fresh food compartment in a partially open position, exposing the mullion assembly arranged with a hydrophilic structure.

In FIGS. 1A and 1B, appliance 10 is shown with the refrigeration compartment 20 (not shown) in an open position, exposing refrigeration compartment interior 21. Doors 22 and 24 are opened, exposing mullion assembly 30, divider mullion 31, and refrigeration compartment interior 21. Mullion assembly 30 is coupled to door 24 with a mullion hinge assembly 34, allowing it to swivel behind door 24. Mullion assembly 30 may also be coupled to door 22 (not shown), or assembly 30 may exist as multiple components, coupled to doors 22 and 24 (not shown). In general, either door 22 or door 24 may be closed or opened first over compartment interior 21. Independent of the door opening sequence, mullion assembly 30 flips behind doors 24 and 22 as door 24 is moved into a closed position over compartment interior 21. Mullion assembly 30 works in concert with doors 22 and 24 to seal compartment interior 21 during operation of refrigerator appliance 10. Hence, various configurations of mullion assembly 30 are feasible, depending on the geometry and particular functionality of appliance 10, and doors 22 and 24.

During standard operation of refrigerator appliance 10, condensation may form on the external surfaces of mullion assembly 30, divider mullion 31 and portions of the cabinet 2 (see FIGS. 1A and 1B), particularly when doors 22 and 24 are resting in a closed position over compartment interior 21. Condensation forms at these locations because there is generally less insulation in mullion assembly 30 and divider mullion 31 compared to the amount of insulation in doors 22 and 24. Similarly, the portion of the cabinet 2 near the seam between a compartment door (e.g., door 22) and the compartment (e.g., refrigeration compartment 20) is prone to condensation for the same reasons. Further, there are heat conduction paths between the ambient environment and the compartment interior 21 along the seams between mullion assembly 30 and doors 22 and 24. Accordingly, mullion assembly 30, divider mullion 31 and portions of the cabinet 2 are prone to developing water condensation on their exterior surfaces during operation of refrigerator appliance 10, particularly in high ambient humidity conditions.

Figure 1C:
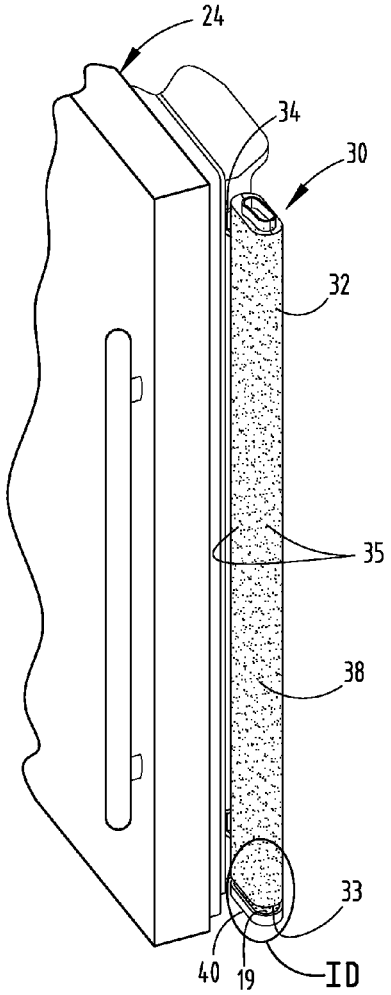
FIG. 1C is an enlarged, perspective view of the mullion assembly depicted in FIG. 1 that shows a hydrophilic structure and a receptacle configured in the mullion assembly for condensation management.
Figure 1D:
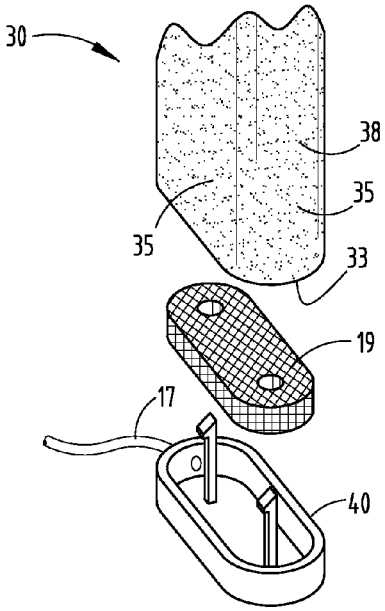
FIG. 1D is an exploded view of the circled portion of the mullion assembly depicted in FIG. 1C.

As depicted in FIGS. 1C and 1D, mullion assembly 30 is configured with features to control and manage external condensation. Mullion assembly 30 includes a mullion bar 32 (see also FIGS. 1 and 1B) and hinge assembly 34. Hinge assembly 34 is movably coupled to mullion bar 32 and door 24. Mullion bar 32 includes exterior surfaces 35 that face away from refrigeration compartment interior 21 (not shown) and a bottom face 33. A hydrophilic structure 38 is arranged along the exterior surfaces of mullion bar 32. Further, a receptacle 40 may be coupled to mullion bar 32 along the mullion bar bottom face 33.

Mullion bar 32 may be fabricated in various shapes and configurations to accommodate refrigeration compartment 20 and doors 22 and 24. Further, mullion assembly 30 may include one or more mullion bar 32 components to accomplish the intended function. In addition, mullion bar 32 may be fabricated from various materials, including but not limited to food-safe polymers, metals, alloys, composites and other materials with adequate thermal insulation.

The hydrophilic structure 38 acts to drain condensation and/or spread it in a sheet-like form along exterior surfaces 35 downward toward receptacle 40. The hydrophilic structure 38 possesses a surface energy associated with high affinity for water. Accordingly, water tends to grip the hydrophilic structure 38, spreading in a nearly invisible film. Put another way, water does not bead on structure 38 and agglomerate into large, visible water droplets. After spreading in a film along hydrophilic structure 38, the condensation flows down surface 35, beads on face 33, and then drips into receptacle 40 and wicking medium 19 according to the embodiment depicted in FIGS. 1C and 1D. Here, face 33 serves as the transfer point from structure 38 to wicking medium 19. Other transfer points with direct contact between wicking medium 19 and structure 38 are also feasible.

Hydrophilic structure 38 may include various structures arranged over the desired surfaces of appliance 10, including the mullion bar surface 35 as shown in FIGS. 1C and 1D. In particular, hydrophilic structure 38 may include, but is not limited to, a film, layer, multi-layer, coating and/or surface treatment. The structure 38 may comprise various materials, all of which possess surface energies consistent with water affinity. For example, hydrophilic structure 38 may comprise an anti-microbial, wicking material (e.g., Miliken & Company VISA ENDURANCE®) or a hydrophilic coating (e.g., Lotus Leaf Coating, Inc. HYDROPHIL®). Further, hydrophilic structure 38 may be applied to, or processed in situ on, the mullion bar 32. The processes used to apply or form hydrophilic structure 38 on the bar 32 may be selected based on the underlying material and properties of bar 32.

In addition, different regions of mullion bar 32 may be arranged with different hydrophilic structures 38 to preferentially direct water toward desired locations. For example, a water affinity gradient can be configured along the exterior surfaces 35 of bar 32 to preferentially direct water downward toward receptacle 40. This can be accomplished via the selection and positioning of materials for hydrophilic structure 38 along exterior surfaces 35 that have an increasingly hydrophilic property (e.g., increased water affinity) toward the bottom face 33 of mullion bar 32.

Receptacle 40 may be coupled to the bottom face 33 of mullion bar 32 as shown in FIGS. 1C and 1D. Essentially, receptacle 40 is a container that is configured to receive condensation that flows along hydrophilic structure 38 and drips off mullion bar 32. Receptacle 40 may be arranged in various configurations to receive the condensation. However, receptacle 40 should possess sufficient surface area to allow for evaporation of the received condensation at a sufficiently high rate to ensure that condensation from mullion bar 32 does not overflow its walls. Preferably, receptacle 40 is fitted with wicking materials or other similar structures to attract condensation from mullion bar 32. Further, receptacle 40 may include a wicking medium 19 (e.g., a sponge-like material) with anti-microbial properties for storing and drying the unwanted condensation. In addition, tubing 17 or other suitable structures may be employed to direct the condensation stored in receptacle 40 to other locations within or on appliance 10 with sufficient surface area to promote evaporation.

Figure 2:
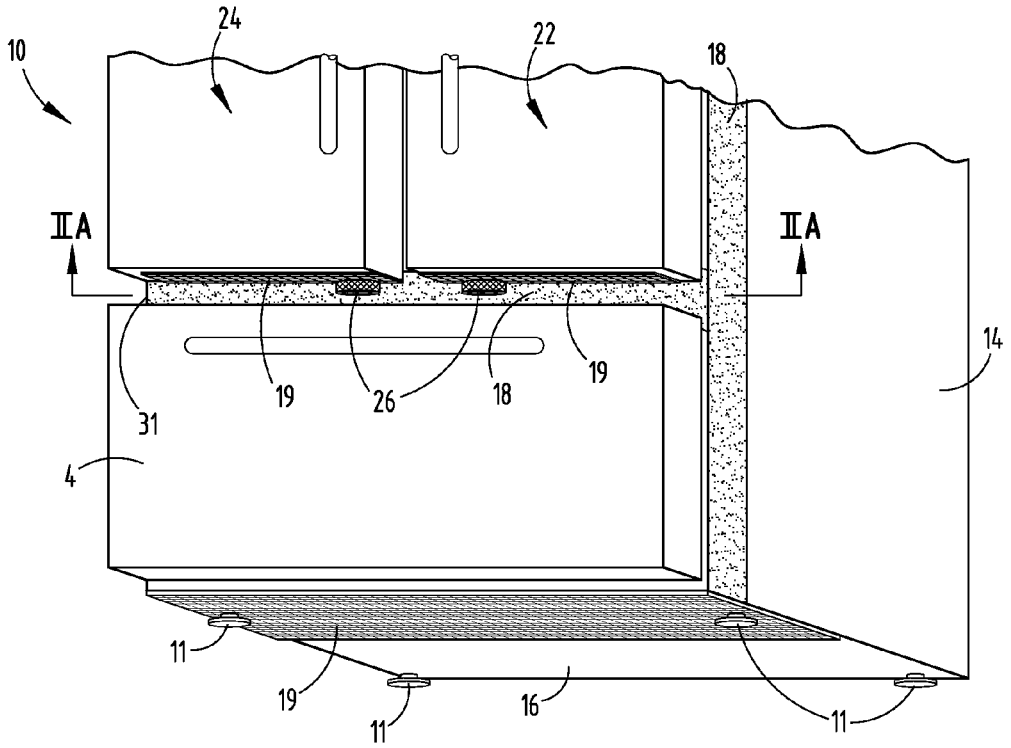
FIG. 2 is an upward-oriented perspective view of a refrigerator appliance in a French door bottom mount configuration depicting wicking media on the underside of the refrigerator compartment doors and bottom of the cabinet.
Figure 2A:
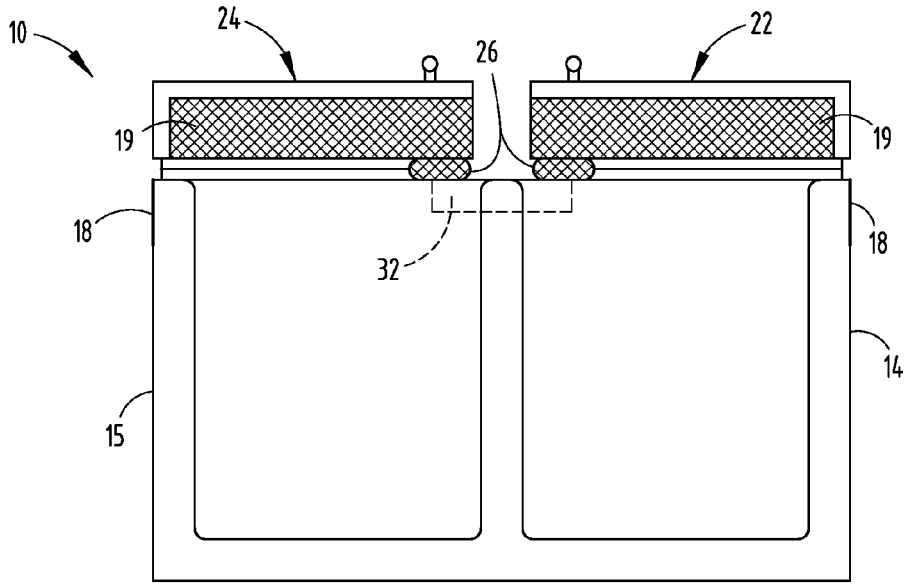
FIG. 2A is a bottom view of the appliance depicted in FIG. 2 through line section IIA-IIA.

Referring to FIGS. 2 and 2A, a portion of a FDBM-type refrigerator appliance 10 is depicted in an upward-oriented perspective view. As shown here, the divider mullion 31 and a portion of the right side 14 of the appliance cabinet are coated with a hydrophilic structure 18 (see also FIGS. 1 and 1B). As discussed earlier, condensation is likely to form on divider mullion 31 and a portion of the cabinet of the appliance nearest the compartment doors. The hydrophilic structure 18 acts to drain the condensation and/or spread it in a sheet-like form across the mullion 31 and the portion of the right side 14 of the cabinet depicted in FIG. 2.

In the embodiment depicted in FIGS. 2 and 2A, however, the bottom faces of refrigeration compartment doors 24 and 22 are configured with a wicking medium 19. When doors 24 and/or 22 are in a closed position, wicking fingers 26 (see FIG. 2A) serve as a transfer point between the wicking medium 19 and the hydrophilic structure 18 over divider mullion 31. Wicking fingers 26 may also be arranged as a transfer point for the wicking medium 19 with the hydrophilic structure 18 over mullion bar 32 (FIG. 2A). Consequently, condensation that has spread along hydrophilic structure 38 on mullion bar 32, hydrophilic structure 18 on divider mullion 31, and portions of the right side 14 and left side 15 of the cabinet of the appliance are drawn up into wicking medium 19 via wicking fingers 26.

Wicking medium 19 used on the bottom of doors 24 and 22 has the same or similar properties as the wicking medium 19 described in connection with the receptacle 40 (see FIGS. 1C and 1D). However, wicking medium 19 configured on the bottom of doors 24 and 22 has sufficient surface area to ensure evaporation of the condensation drawn from the hydrophilic structure 18 (along divider mullion 31).

In addition, the bottom face 16 of the cabinet of appliance 10 is configured with a wicking medium 19 and cabinet feet 11, arranged to raise the cabinet of appliance 10 above the floor. Wicking medium 19 along bottom face 16 is configured in contact with the hydrophilic structures 18 arranged along the right side 14 and left side 15 of the cabinet. Condensation that has spread along hydrophilic structure 18 on portions of the right side 14 and left side 15 of the cabinet is drawn up into wicking medium 19. Here, wicking medium 19 is arranged with substantial surface area beneath the cabinet of appliance 10 along bottom face 16. Condensation within wicking medium 19 is readily evaporated by virtue of this surface area, along with the air flow and heat dissipation associated with certain components of refrigerator appliance 10, including the condenser and the compressor (both not shown).

Figure 3:
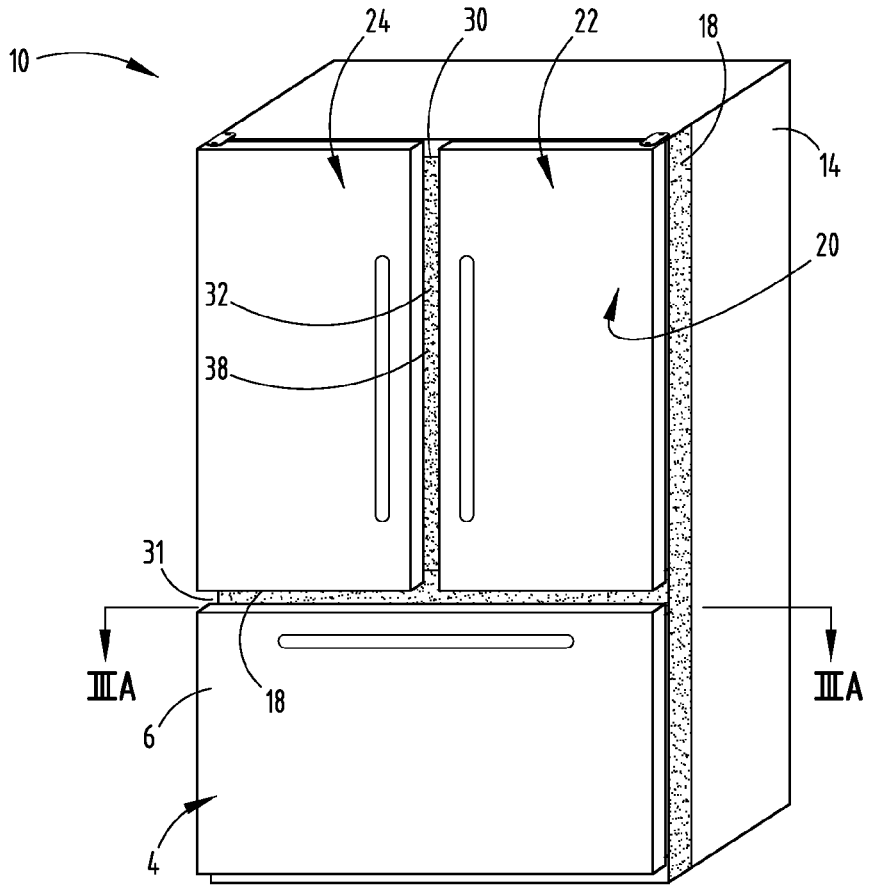
FIG. 3 is a downward-oriented perspective view of the refrigerator appliance depicted in FIG. 2 illustrating a wicking bulb arrangement within the freezer compartment door.
Figure 3A:
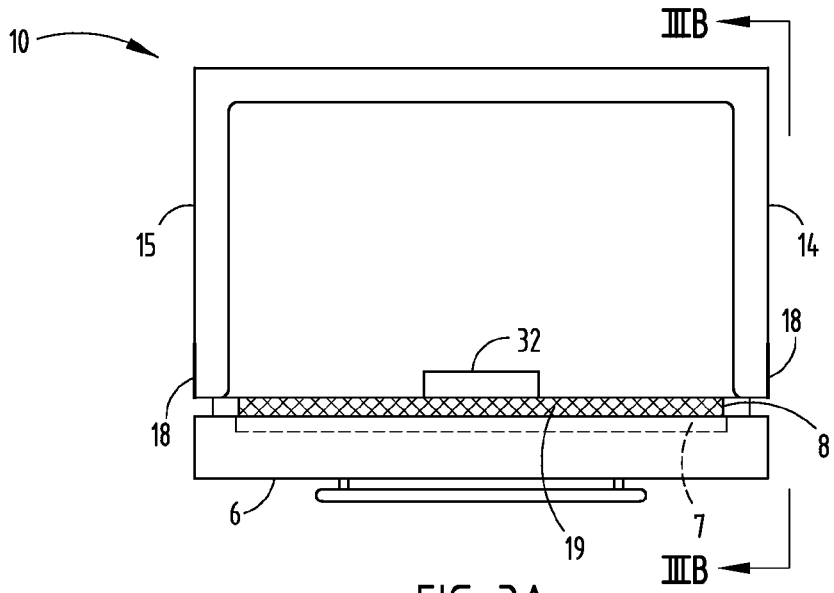
FIG. 3A is a bottom view of the freezer compartment door of the refrigerator appliance shown in FIG. 2 through line section IIIA-IIIA.
Figure 3B:
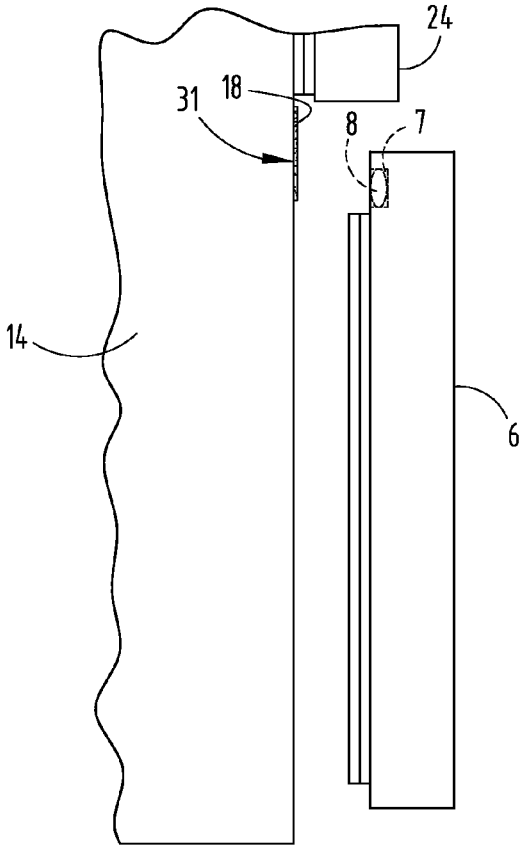
FIG. 3B is a side view of the freezer compartment door in an open position and the cabinet of the appliance shown in FIG. 2 through line section IIIB-IIIB.
Figure 3C:
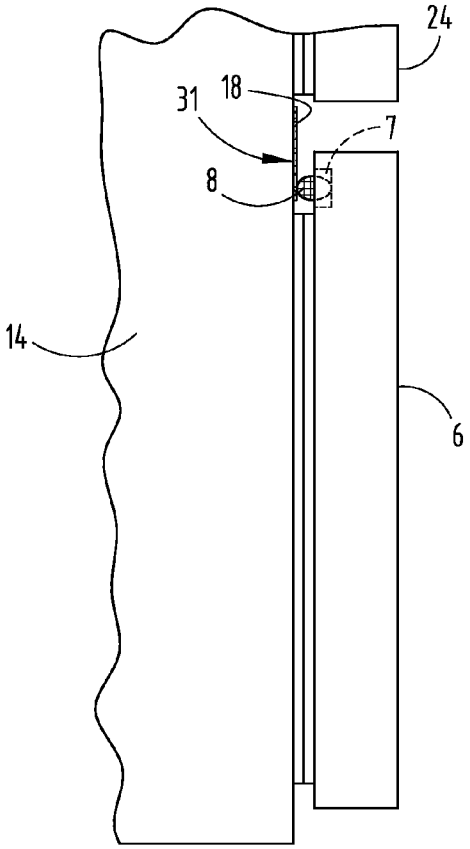
FIG. 3C is a side view of the freezer compartment door in a closed position and the cabinet of the appliance shown in FIG. 2 through line section IIIC-IIIC.

Another condensation management embodiment is depicted in FIGS. 3-3C. As shown in FIG. 3, a FDBM-type refrigerator appliance 10 is depicted in a slightly downward-oriented perspective view. The divider mullion 31 and a portion of the right side 14 (and a portion of the left side 15 of the cabinet, not shown) of the appliance cabinet are coated with a hydrophilic structure 18. As discussed earlier, condensation is likely to form in these locations. In addition, hydrophilic structure 18 acts to drain the condensation and/or spread it in a sheet-like form across the mullion 31 and the portion of the right side 14 of the cabinet depicted in FIG. 3.

In the embodiment depicted in FIGS. 3 through 3C, a freezer compartment pocket 7 is configured within the freezer compartment door 6. Pocket 7 houses a freezer compartment wicking bulb 8 (FIG. 3A). When door 6 resides in an open position, wicking bulb 8 is retracted within pocket 7 such that it is not readily visible (FIG. 3B). As door 6 is moved to a closed position against the cabinet of appliance 10, wicking bulb 8 extends to couple the wicking bulb 8 to the hydrophilic structure 18 over divider mullion 31 (FIG. 3C). Consequently, condensation that has spread along hydrophilic structure 18 on divider mullion 31 and portions of the right side 14 (and left side 15, not shown) of the cabinet of the appliance is drawn up into wicking bulb 8. Wicking bulb 8 used within door 6 has the same or similar properties as the wicking medium 19 described in connection with the receptacle 40 (see FIGS. 1C and 1D). However, wicking bulb 8 configured within freezer compartment door 6 has sufficient surface area to ensure evaporation of the condensation drawn from the hydrophilic structure 18 (along divider mullion 31).

Various configurations can be employed to give wicking bulb 8 an extension capability from within pocket 7. In particular, these configurations allow wicking bulb 8 to extend from the pocket 7 to touch the divider mullion 31 when door 6 is moved to a closed position. In one approach, a magnet (not shown) is configured within wicking bulb 8. As door 6 is moved to a closed position, the magnet within bulb 8 causes bulb 8 to extend toward the cabinet of appliance 10. This approach is viable for most configurations of appliance 10, provided that the appliance contains an appreciable amount of ferrous material within the exterior portions of its cabinet.

Figure 4:
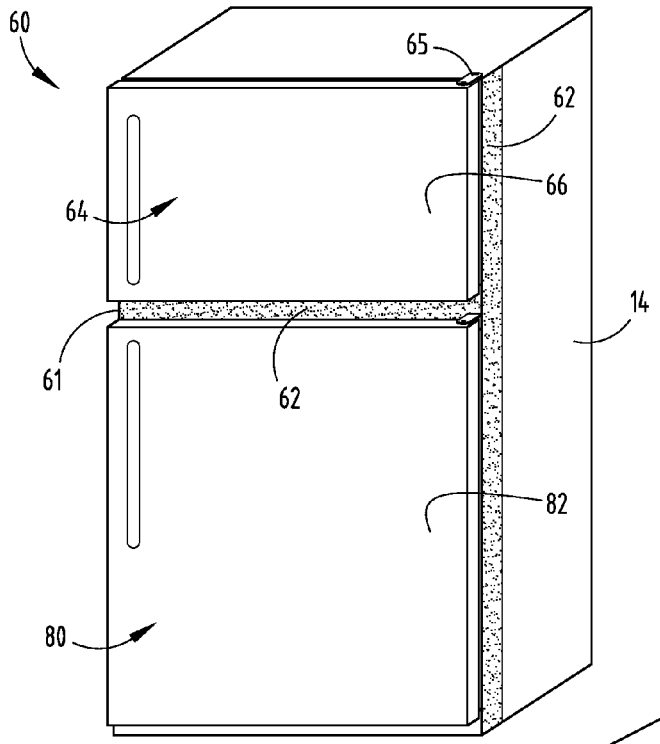
FIG. 4 is a perspective view of a refrigerator appliance in a top-freezer mount configuration.
Figure 4A:
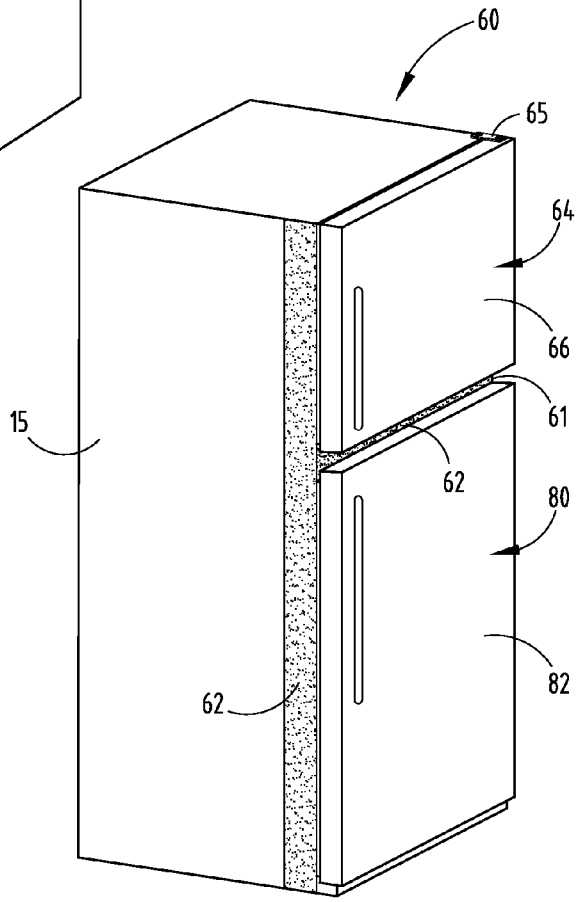
FIG. 4A is a side, perspective view of the refrigerator appliance shown in FIG. 4.

As depicted in FIGS. 4 and 4A, a refrigerator appliance 60 in a top-freezer mount arrangement may also be configured for condensation management. In particular, refrigerator appliance 60 is arranged with freezer compartment 64 located above refrigeration compartment 80 (e.g., the fresh food compartment). Freezer compartment 64 is configured with a freezer compartment door 66. Freezer compartment door 66 is coupled to the cabinet of appliance 60 via hinge assembly 65. Similarly, refrigeration compartment 80 includes a refrigeration compartment door 82. A hinge assembly (not shown) is configured to couple refrigeration compartment door 82 to the right side 14 of the cabinet of appliance 60. Further, a divider mullion 61 separates the freezer compartment 64 from the refrigeration compartment 80.

As also shown in FIGS. 4 and 4A, hydrophilic structures 62 are arranged along divider mullion 61 and portions of the right side 14 and left side 15 of the cabinet of appliance 60. The hydrophilic structure 62 acts to drain condensation and/or spread it in a sheet-like form. The function, configuration and structure of hydrophilic structure 62 is the same as the hydrophilic structure 38 described earlier in connection with the embodiments depicted in FIGS. 1-3.

During standard operation of refrigerator appliance 60, condensation may form on the external surfaces of divider mullion 61 and portions of the right side 14 and left side 15 of the cabinet of appliance 60 (FIGS. 4 and 4A). This condensation often occurs when doors 66 and 82 are resting in a closed position on the cabinet. Condensation forms at these locations for the same reasons as described in connection with appliance 10 (see FIGS. 1A and 1B).

Figure 5:
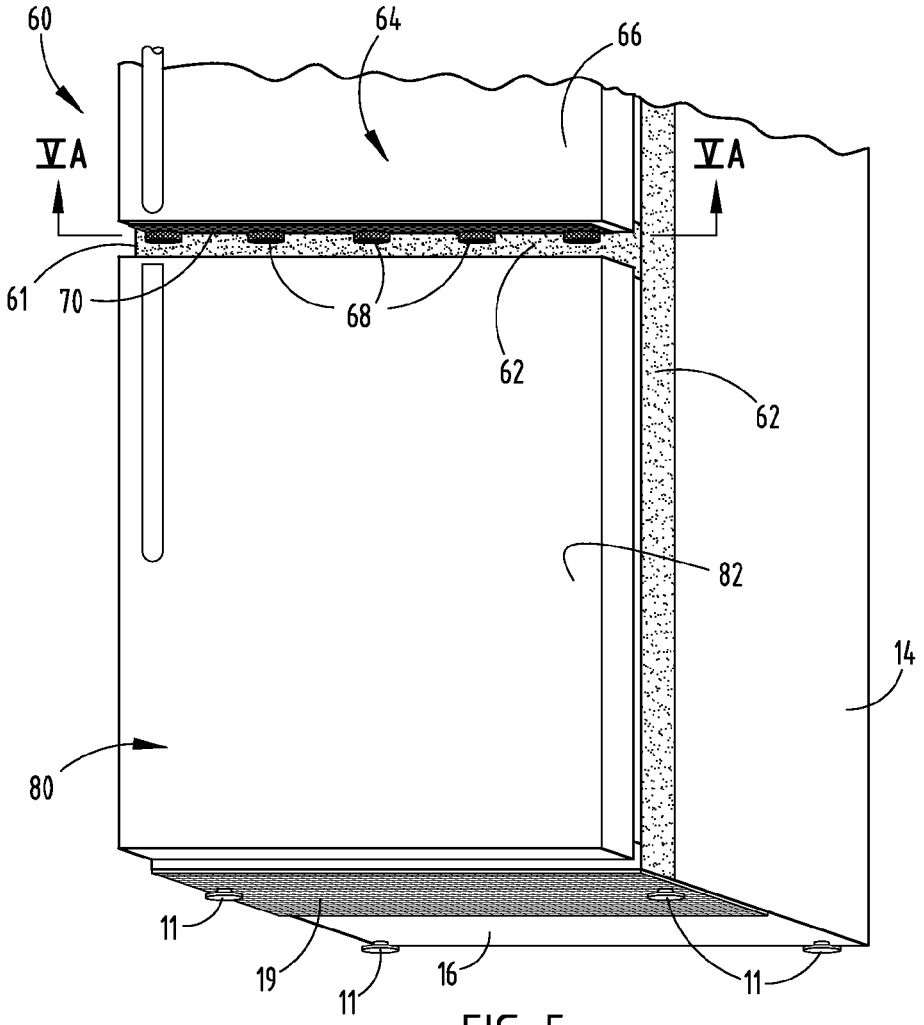
FIG. 5 is an upward-oriented perspective view of the refrigerator appliance shown in FIG. 4 depicting wicking media on the underside of the freezer door and bottom of the cabinet.
Figure 5A:
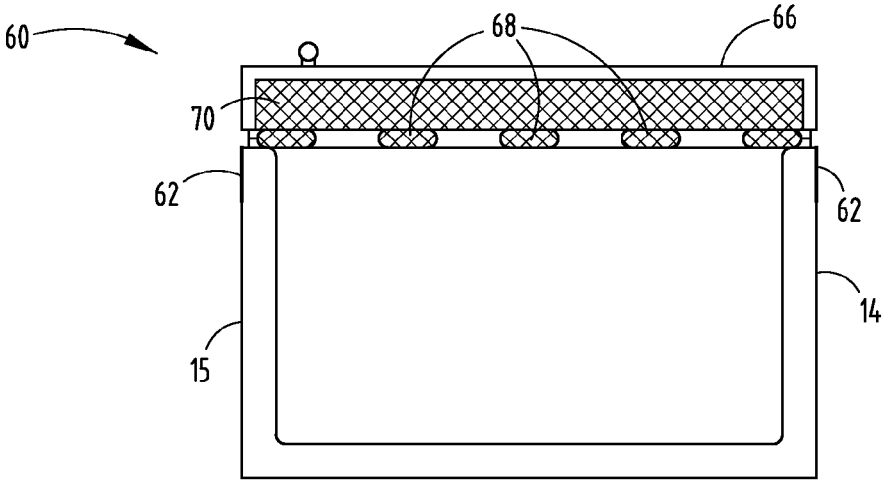
FIG. 5A is a bottom view of the appliance depicted in FIG. 4 through line VA-VA.

Embodiments for managing condensation in the appliance 60 are depicted in FIGS. 5 and 5A. Two approaches are identified here that are similar to those described in connection with appliance 10 and depicted in FIGS. 2 and 2A. Note, however, that other suitable condensation management configurations can be used with appliance 60, drawing on the teachings associated with the embodiments described earlier. First, condensation that has spread on hydrophilic structure 62 along the right side 14 and left side 15 of the cabinet of appliance 60 may be moved toward wicking medium 19 (see FIG. 5). Wicking medium 19 is configured along the bottom surface 16 of the cabinet of appliance 60 and cabinet feet 11, arranged to raise the cabinet of appliance 60 above the floor. Wicking medium 19 is further arranged in contact with the right side 14 and left side 15 of the cabinet. Further, wicking medium 19 is arranged with substantial surface area beneath the cabinet of appliance 60 along bottom surface 16. Condensation that has spread along hydrophilic structure 62 on portions of the right side 14 and left side 15 of the cabinet is drawn up into wicking medium 19. Condensation within wicking medium 19 is readily evaporated by virtue of its surface area, along with the air flow and heat dissipation associated with certain components of refrigerator appliance 60, including the condenser and the compressor (both not shown).

Second, as shown in FIGS. 5 and 5A, the bottom faces of refrigeration compartment door 66 is configured with a wicking medium 70. When door 66 is in a closed position, wicking fingers 68 (see FIG. 5A) couple the wicking medium 70 to the hydrophilic structure 62 over divider mullion 61. Consequently, condensation that has spread along hydrophilic structure 62 on divider mullion 61 and portions of the right side 14 and left side 15 of the cabinet of appliance 60 is drawn up into wicking medium 70 via wicking fingers 68. Wicking medium 70 used on the bottom of door 66 has the same or similar properties as the wicking medium 19 described in connection with the receptacle 40 (see FIGS. 1C and 1D). However, wicking medium 70 configured on the bottom of door 64 has sufficient surface area to ensure evaporation of the condensation drawn from the hydrophilic structure 62 (along divider mullion 61).

It should be apparent to one of ordinary skill in the art that these condensation management and control features described above and depicted in FIGS. 1-5A may be employed in other locations within refrigerator appliances prone to external condensation. Furthermore, the particular embodiments described are exemplary of the possible condensation management systems that can be employed as taught by the invention. Indeed, these configurations may be equally applicable for use in other appliances and systems subject to unwanted external condensation.

Other variations and modifications can be made to the aforementioned structures and methods without departing from the concepts of the present invention. For example, other refrigerator appliance configurations can be used with these condensation management arrangements. These concepts, and those mentioned earlier, are intended to be covered by the following claims unless the claims by their language expressly state otherwise.

The invention claimed is:

1. An appliance, comprising:
a cabinet having an exterior surface;
a refrigeration compartment located within the cabinet;
a hydrophilic structure disposed on the exterior surface, the hydrophilic structure configured to spread condensation; and
a wicking structure located in proximity to the hydrophilic structure, wherein the wicking structure is configured to receive the condensation.

2. The appliance of claim 1, wherein the hydrophilic structure has a water affinity gradient configured to direct the condensation toward the wicking structure.

3. The appliance of claim 1, wherein the wicking structure is disposed within a receptacle.

4. The appliance of claim 1, wherein the hydrophilic structure comprises anti-microbial material.

5. The appliance of claim 1, wherein the wicking structure comprises anti-microbial material.

6. The appliance of claim 3, wherein the receptacle is configured for evaporation of the condensation.

7. An appliance, comprising:
a cabinet having an exterior surface;
a refrigeration compartment located within the cabinet;
a hydrophilic structure disposed on the exterior surface, the hydrophilic structure configured to spread condensation; and
a wicking finger in contact with the hydrophilic structure, wherein the wicking finger transfers the condensation from the hydrophilic structure to a wicking structure located on the cabinet that is configured to receive the condensation from the wicking finger.

8. The appliance of claim 7, wherein the hydrophilic structure has a water affinity gradient configured to direct the condensation toward the wicking finger.

9. The appliance of claim 7, wherein the hydrophilic structure comprises anti-microbial material.

10. The appliance of claim 7, wherein the wicking structure comprises anti-microbial material.

11. The appliance of claim 7, wherein the wicking structure is further configured for evaporation of the condensation.

12. The appliance of claim 11, wherein the wicking structure is located on a bottom surface of the cabinet.

13. An appliance, comprising:
a cabinet having an exterior surface;
a refrigeration compartment located within the cabinet;
a hydrophilic structure disposed on the exterior surface, the hydrophilic structure configured to spread condensation; and
a wicking structure comprising a sponge-like material, the wicking structure configured to receive the condensation from the hydrophilic structure.

14. The appliance of claim 13, wherein the hydrophilic structure has a water affinity gradient configured to direct the condensation toward the wicking structure.

15. The appliance of claim 13, wherein the wicking structure comprises a transfer structure for transferring the condensation and a wicking medium for receiving the condensation.

16. The appliance of claim 13, wherein the wicking structure comprises a wicking medium for receiving the condensation.

17. The appliance of claim 13, wherein the hydrophilic structure comprises anti-microbial material.

18. The appliance of claim 13, wherein the wicking structure comprises anti-microbial material.

19. The appliance of claim 13, wherein the refrigeration compartment further comprises a refrigeration compartment door, and the wicking structure is a retractable wicking bulb within the compartment door that extends to contact the hydrophilic structure when the door is in a closed position.

20. The appliance of claim 16, wherein the wicking medium is further configured for evaporation of the condensation.

* * * * *